US007278283B2

(12) United States Patent
Meckbach

(10) Patent No.: US 7,278,283 B2
(45) Date of Patent: Oct. 9, 2007

(54) PADLOCK

(75) Inventor: Gerhard Meckbach, Hagen (DE)

(73) Assignee: ABUS August Bremicker Soehne KG, Wetter-Volmarstein (DE)

( * ) Notice: Subject to any disclaimer, the term of this patent is extended or adjusted under 35 U.S.C. 154(b) by 36 days.

(21) Appl. No.: 10/833,498

(22) Filed: Apr. 27, 2004

(65) Prior Publication Data

US 2005/0235709 A1 Oct. 27, 2005

(51) Int. Cl.
*E05B 67/24* (2006.01)

(52) U.S. Cl. ..... 70/38 R; 70/20; 70/31; 70/35; 292/DIG. 38

(58) Field of Classification Search ..... 70/20–49, 70/51–56; 292/DIG. 38
See application file for complete search history.

(56) References Cited

U.S. PATENT DOCUMENTS 4,226,100 A * 10/1980 Hampton et al. ..... 70/51
4,502,305 A * 3/1985 Bakker ..... 70/49
4,658,606 A * 4/1987 Tseng ..... 70/38 A
5,755,121 A * 5/1998 Crass ..... 70/52
5,865,307 A * 2/1999 Friedman ..... 206/37.1
5,960,652 A * 10/1999 Marmstad ..... 70/49
6,430,975 B1 * 8/2002 McDaid ..... 70/39
6,725,692 B2 * 4/2004 Weinraub ..... 70/38 A
2002/0078720 A1 * 6/2002 Watts ..... 70/38 A
2003/0121295 A1 * 7/2003 Lavikainen et al. ..... 70/38 A
2003/0159479 A1 * 8/2003 Kajuch et al. ..... 70/379 R
2004/0194515 A1 * 10/2004 Weinraub ..... 70/49

OTHER PUBLICATIONS

American Lock USA; Product Line Guide; pp. 22-23.
Brady Signmark, The Reference For Identificationl; Product Line Guide; 2002-2003; pp. 139-140; United Kingdom.
Master Lock, Safety Series; Safety Lockout Products Guide; pp. 3-5.

* cited by examiner

*Primary Examiner*—Brian E. Glessner
*Assistant Examiner*—Christopher Boswell
(74) *Attorney, Agent, or Firm*—Townsend and Townsend and Crew, LLP

(57) ABSTRACT

A padlock has a lock body comprising a housing, furthermore a lock hoop adjustably secured to the lock body, a lock cylinder accommodated in the housing and a latching mechanism accommodated in the housing. The latching mechanism enables a latching of the hoop to the lock body. The latching mechanism releases at least one end of the hoop on an opening actuation of the lock cylinder so that this hoop end can be removed from the lock body. The housing consists of an electrically insulating material at least at the outer side. The hoop and the lock cylinder are electrically insulated from one another by an additional measure.

6 Claims, 7 Drawing Sheets

PADLOCK

BACKGROUND OF THE INVENTION

The invention relates to a padlock which has a lock body comprising a housing, furthermore a lock hoop adjustably secured to the lock body, a lock cylinder accommodated in the housing and a latching mechanism accommodated in the housing. The latching mechanism enables a latching of the usually U-shaped hoop to the lock body such that the hoop forms a closed loop together with the lock body and the padlock can be used for securing purposes.

The lock cylinder is in mechanical connection with the latched hoop via the latching mechanism. An opening actuation of the lock cylinder can usually take place by a rotary actuation of a key associated with the lock cylinder. On such an opening actuation, the latching mechanism releases at least one end of the hoop, for example in that a driver projection of the lock cylinder rotates a bolt standing in active connection with the hoop about a pre-determined angle of rotation. This hoop end can thereby be removed from the lock body and pivoted, for example, to the side. The loop is opened in this manner.

A particular area of application of such a padlock is in the field of occupational safety. In connection with the servicing of production machinery, it is customary for the service personnel to block a master electrical switch of a control device or of a power switch cabinet during the maintenance work so that the master switch is not accidentally activated by another person while the maintenance work is still being carried out at the production machine at another position. For this purpose, a padlock can be hung on an eyelet of the master switch and latched so that the master switch is blocked against actuation and thus against activation. In this connection, the padlock used is termed a "lock-out" lock.

So that a plurality of service personnel can block and release the master switch again independently of one another, a safety clamp can also additionally be provided which is hung into the eyelet of the master switch and which has a plurality of hanging eyelets each for one "lock-out" lock. Only when the last lock has been removed from the safety clamp can the safety clamp be removed from the master switch so that it can again be activated.

It is in particular known to make the housing from plastic for such "lock-out" locks. The respective housing of different locks can thereby be given a different color in order to permit a simple and fast visual association to different users.

SUMMARY OF THE INVENTION

An object of the invention consists of even further improving the suitability of a padlock as a "lock-out" lock for control devices and power switch cabinets.

This object is satisfied for a padlock of the initially named kind in that the hoop and the lock cylinder are electrically insulated from one another.

In the padlock in accordance with the invention, that part of the lock cylinder accessible to the user is therefore electrically insulated from the lock hoop although—at least with a latched hoop—a mechanical connection usually exists between the lock cylinder and the hoop via the latching mechanism. For this purpose, an electrical insulation of this mechanical connection is provided at the hoop, at the latching mechanism and/or at the lock cylinder. No electrical current can therefore flow between the hoop and the lock cylinder. Since the housing of the lock body is also additionally made of an electrically insulating material— such as plastic or a ceramic material—an electrical current flow can also not take place along the housing between the hoop and the lock cylinder.

A particular advantage of this padlock consists of the improved security of the user in the case of the explained application as a "lock-out" lock. Since such "lock-out" locks, as explained, are attached to electrical switches of control devices or power switch cabinets, a certain risk is present that an electrical voltage is accidentally applied to the relevant switch which could lead to a possibly dangerous current flow through the body of the lock user. This risk is reduced in the padlock in accordance with the invention since the lock hoop with which the lock is hung onto the switch or onto an associated safety clamp is electrically insulated from the lock cylinder. An electrical current can thus not flow from the hoop to a key which the user has introduced into the lock cylinder.

A further advantage of the padlock in accordance with the invention consists of the fact that a plurality of parts of this lock—as will be explained in the following—can be made of plastic or of ceramic material in order to achieve the desired insulation properties. A low weight of the padlock can thereby be achieved, which is particularly advantageous in the application as a "lock-out" lock, since the service personnel frequently carry a plurality of such "lock-out" locks at the same time. Moreover, such a lock can be manufactured in a cost-favorable manner by the use of plastic parts, since the portion of metal as the material used can be reduced.

It is preferred for the already named latching mechanism, which mechanically connects the lock cylinder to the hoop at least with a latched hoop, to establish the desired electrical insulation between the hoop and the lock cylinder. In the region of the latching mechanism, the use of electrically insulating materials—instead of the usually used material—is particularly easily possible without impairing the stability and security against being broken open of the padlock; the lock hoop can, for example, be made as usual from metal. It is moreover ensured that a component provides the electrical insulation which is accommodated at the interior of the lock body; an accidental bridging of the electrical connection is thereby precluded.

A component of the latching mechanism or of the total latching mechanism can in particular be produced from an electrically insulating material such as plastic or a ceramic material. It is also possible for a component of the latching mechanism not to be completely made of the electrically insulating material, but only to carry such an electrically insulating material at the outer contact surfaces, for example on the basis of a covering or of a coating.

In accordance with a first embodiment, the latching mechanism has a bolt and at least one blocking element which cooperates therewith and which can be brought into blocking engagement with the hoop. The bolt is directly coupled to the lock cylinder and is made completely or partly from an electrically insulating material.

In accordance with a further embodiment, the latching mechanism has a bolt, at least one blocking element cooperating therewith and, additionally, an adapter part via which the bolt is indirectly coupled to the lock cylinder, with the adapter part consisting completely or partly of an electrically insulating material.

In accordance with a further embodiment, the latching mechanism has a bolt and at least one blocking element which cooperates therewith and which can be brought into blocking engagement with the hoop and is completely or partly produced of an electrically insulating material.

In accordance with a further embodiment, the latching mechanism is formed by a single bolt element which is coupled to the lock cylinder and can be brought into blocking engagement with the hoop, with this bolt element consisting completely or partly of an electrically insulating material.

It is preferred with respect to the aforesaid embodiments for the total hoop or for at least that section of the hoop which projects from the lock body with a latched temple to be provided with an electrically insulating covering. The risk can thereby be reduced that an electrical voltage is transmitted to the latching mechanism at all.

Alternatively to the design of such a covering, the hoop itself can be produced from an electrically insulating material. In this case, it is not absolutely necessary for the latching mechanism also to consist of an electrically insulating material, since an electrical separation between the hoop and the lock cylinder is already ensured.

The object of the invention is also satisfied for a padlock of the initially named kind in that the hoop is admittedly made of metal, but at least that section of the hoop which projects from the lock body when the hoop is latched to the lock body has a smaller diameter than a respective guide section of the hoop ends which projects into the lock body when the hoop is latched to the lock body and in that the hoop has an electrically insulating covering along the section with the smaller diameter.

In this padlock, the lock cylinder ultimately accessible to the user is therefore also electrically insulated from the lock hoop, with this insulation already being achieved in that the hoop is provided with a covering of an electrically insulating material and thus is not able to further conduct electrical current even when in contact with a live part. Since the housing consists of an electrically insulating material, an electrical current flow along the housing is also precluded. This padlock is thus also particularly well suited as a "lock-out" lock.

Since the electrically insulating covering is applied along a section of the metal hoop with a reduced diameter, the total diameter of the hoop section projecting from the lock body can have a customary dimension and is not undesirably thickened there. This promotes the application as a "lock-out" lock, since the eyelets of the electrical switches to be blocked usually have a limited internal diameter. The guide sections of the metal hoop ends, which project into the lock body when the hoop is latched, in contrast have a larger diameter which preferably corresponds to the outer diameter of the covering. A higher mechanical stability of the latched hoop, and above all a better guidance on the insertion of the hoop into the lock body, are thereby ensured. This is in particular important because a plastic housing does not ensure the same stable guidance of the hoop ends as, for example, a metal housing.

BRIEF DESCRIPTION OF THE DRAWINGS

The invention will be described in the following only by way of example with reference to the drawings.

DESCRIPTION OF THE PREFERRED EMBODIMENTS

Figure 1:
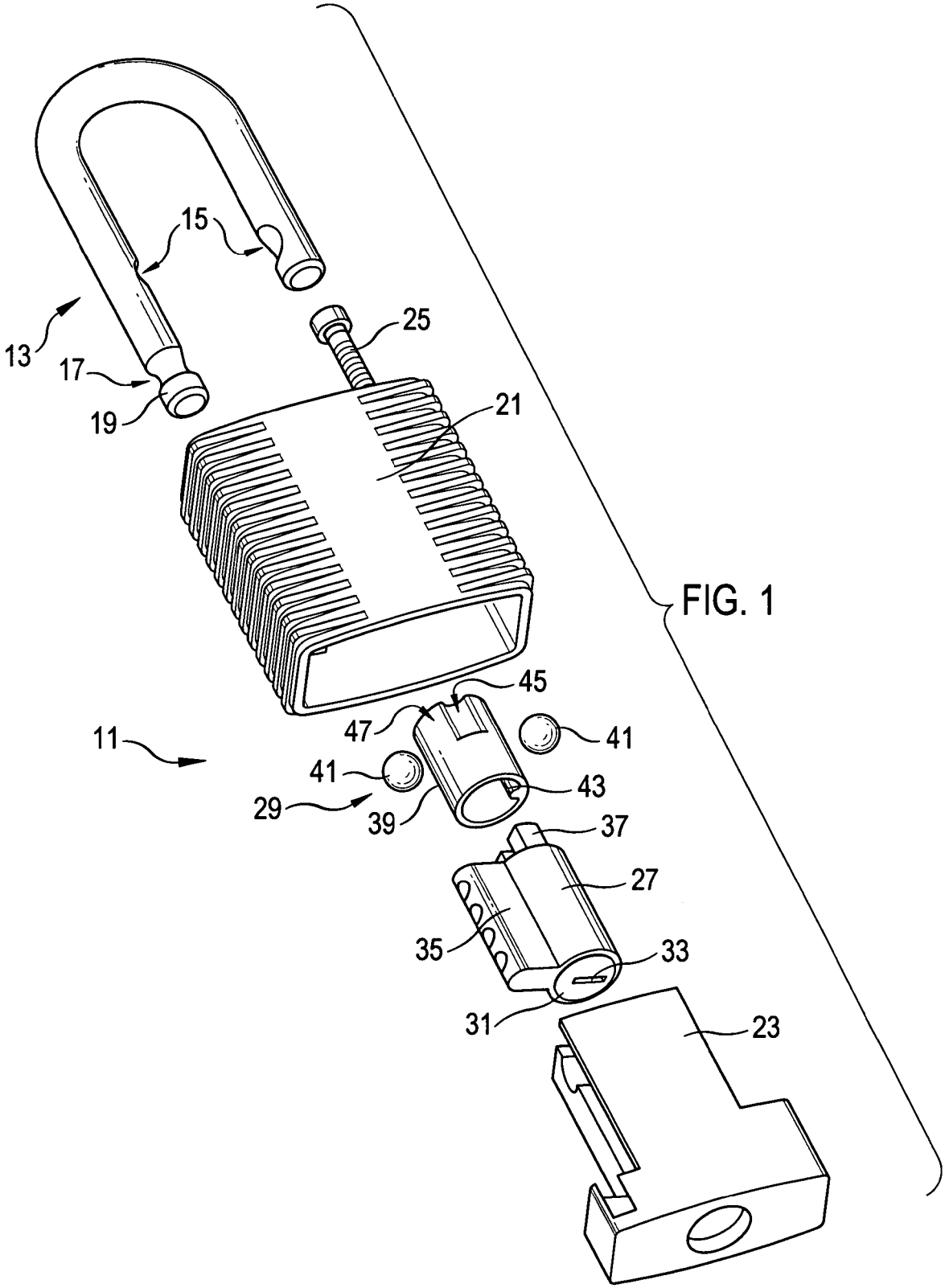
FIG. 1 shows the basic design of a padlock in accordance with the invention in an exploded view.

FIG. 1 shows the basic design of a padlock in accordance with the invention. It has a lock body 11 and a lock hoop 13. The hoop 13 has a U shape with one shorter limb and one longer limb. An inwardly directed latching recess 15 is formed at both limbs. Furthermore, a ring groove 17 with an abutment head 19 adjoining it is provided at the free end of the longer limb.

The lock body 11 has an outer housing part 21 and an inner housing part 23. These each consist completely, or at least at the outer side, of an electrically insulating plastic, for example of PBT (polybutylene terephthalate). The inner housing part 23 can be pushed into the outer housing part 21 and fixed to the outer housing part 21 by means of a securing screw 25, as will be explained in the following. The outer housing part 21 and the inner housing part 23 accommodate a lock cylinder 27 and a latching mechanism 29.

The lock cylinder 27 has, in a manner known per se, a cylinder core 31 with a keyway 33. The cylinder core 31 is rotatably supported inside a cylinder housing 35, with a rotary actuation only being possible when an associated key is introduced into the keyway 33 and urges pin tumblers (not shown) arranged in the cylinder housing 35 into a release position. The cylinder core 31 has a driver projection 37 at the rear side.

The latching mechanism 29 in the exemplary representation in accordance with FIG. 1 has a rotary bolt 39 and two blocking balls 41 arranged lying opposite with respect to the rotary bolt 39. The rotary bolt 39 has a substantially hollow cylindrical shape with an engagement neck 43 at the inner side which permits a rotationally fixed coupling to the driver projection 37 of the lock cylinder 27. The rotary bolt 39 has two receiving recesses 45 which lie diametrically opposite one another at its outer side and which can partly accept the blocking balls 41 on an opening actuation of the lock cylinder 27 and thus of the rotary bolt 39. At the periphery, in each case adjacent to the receiving recesses 45, the rotary bolt 39 forms latching sections 47 by which the blocking balls 41 are held in blocking engagement with the latching recesses 15 of the hoop 13, as will be explained in the following.

The padlock shown in FIG. 1 alternatively enables the latching of the hoop 13 to the lock body 11 or the release of the shorter limb of the hoop 13 from the lock body 11 by a corresponding actuation of the lock cylinder 27 by means of an associated key, for example in order to be able to introduce an eyelet into the lock hoop 13 or to be able to remove it therefrom. The padlock shown is in particular suitable for the already explained use as a "lock-out" lock.

In accordance with the invention, the hoop 13 and the lock cylinder 27 are electrically insulated from one another so that, on contacting the lock cylinder 27 or on actuation of the lock cylinder 27 by means of an electrically conductive key, no electrical current is transmitted to the user, even if an electrical voltage is unintentionally applied to the hoop 13. The lock thus provides increased security for the user in particular when used to block electrical master switches of control devices or of current switch cabinets.

The bringing about of this electrical insulation between the hoop 13 and the lock cylinder 27 will be explained in more detail in the following with reference to different embodiments, with similar parts each being characterized by the same reference numerals.

Figure 2:
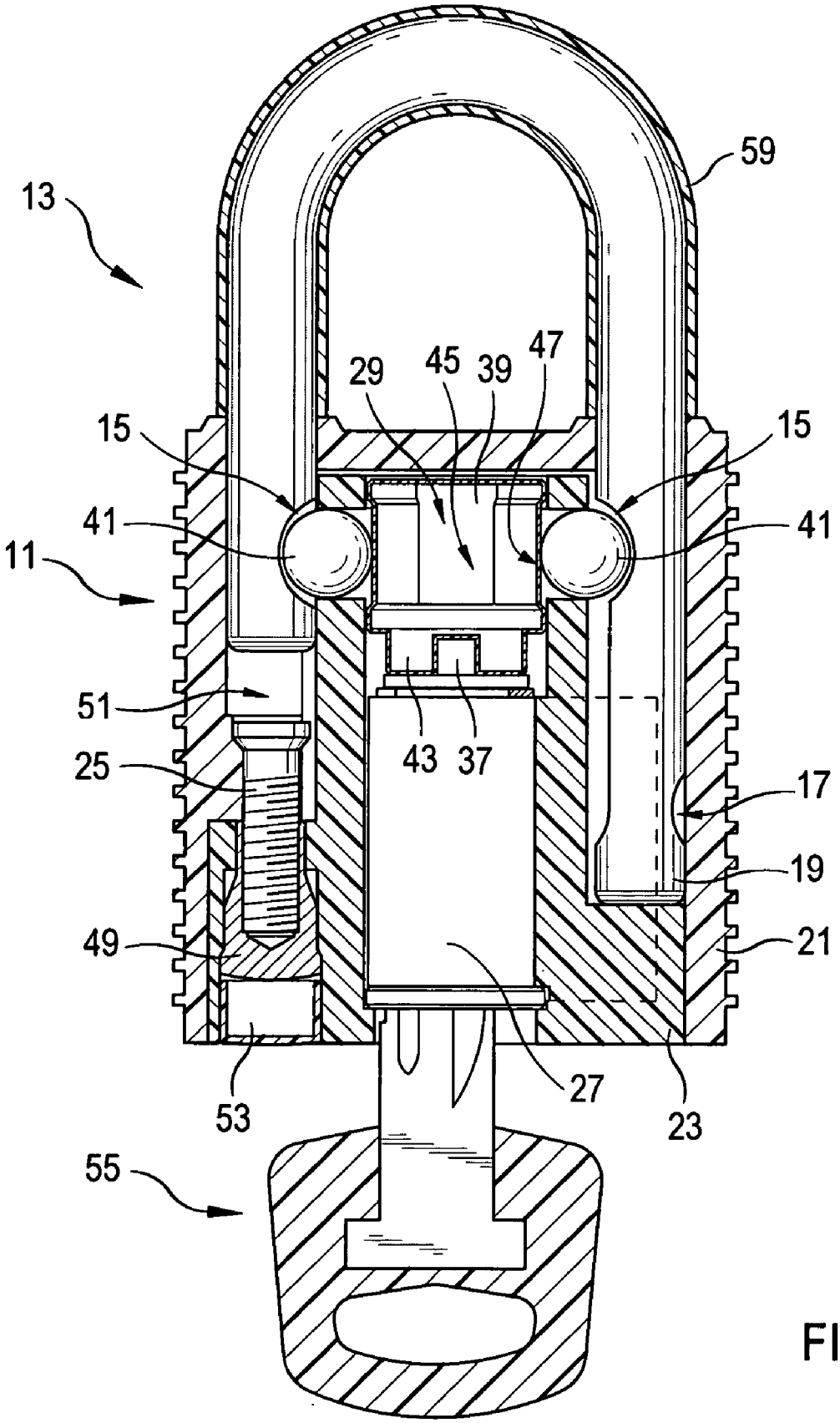
FIG. 2 shows a first embodiment of a padlock in accordance with the invention in a cross-section whose latching mechanism has a rotary bolt and two blocking balls.

FIG. 2 shows a cross-sectional view of a padlock in accordance with a first embodiment in the assembled state and with the latched hoop 13.

As already mentioned, the inner housing part 23 is pushed into the outer housing part 21 and fixed to the outer housing part 21 by means of the securing screw 25 for the installation of this lock. The lock cylinder 27 and the latching mechanism 29 are thereby captured in the housing. The securing screw 25 cooperates, for example, with a nut 49 rotationally fixedly inserted into the inner housing part 23; alternatively, the securing screw 25 can also be screwed into the inner housing part 23 in a self-tapping manner. The securing screw 25 is inserted into a receiving passage 51 of the outer housing part 21 which is closed by the hoop 13 when the hoop 13 is latched to the lock body 11, as shown in FIG. 2. The nut 49 is covered by means of a cover 53 of plastic.

In the embodiment in accordance with FIG. 2, the latching mechanism 29 is formed by a rotatably supported rotary bolt 39 and two laterally displaceable blocking balls 41. FIG. 2 shows a state of the lock in which the hoop 13 is latched and is thus secured against removal from the lock body 11. The latching sections 47 of the rotary bolt 39 hold the blocking balls 41 in blocking engagement with the latching recesses 15 of the hoop 13 for this purpose.

To unlatch the lock, a rotary opening actuation by means of an associated key 55 is required. The driver projection 37 of the lock cylinder 27 and the rotary bolt 39 directly coupled thereto are rotated by 90° so that a respective receiving recess 45 of the rotary bolt 39 is rotated into the region of the blocking balls 21. The blocking balls 41 can thus move back out of the latching recesses 15 of the hoop 13. The hoop 13 can now be pulled out of the lock body 11 axially until the abutment head 19 of the longer hoop limb abuts the blocking ball 41 shown on the right-hand side in FIG. 2. The shorter limb of the hoop 13 (left-hand side in accordance with FIG. 2) now already projects from the lock body 11. The hoop 13 can now be rotated about the longitudinal axis of the longer hoop limb since the blocking ball 41 on the right in the representation in accordance with FIG. 2 engages into the ring groove 17 of the hoop 13.

The repeat latching of the hoop 13 to the lock body 11 takes place in reverse order; i.e. the hoop 13 is again brought back into the position shown in FIG. 2 and the blocking balls 41 are again brought into blocking engagement with the latching recesses 15 by a 90° rotation of the rotary bolt 39 and by means of the key 55.

The special feature of the embodiment shown in FIG. 2 consists of the fact that the hoop 13 and the lock cylinder 27 are electrically insulated from one another, although both the hoop 13 and the lock cylinder 27 are substantially made from metal and although these parts 13, 27 are mechanically coupled in the explained manner. For this purpose, the rotary bolt 39 is not made of metal—as usual—but of plastic, for example of vinyl. An electrical current flow can thus not take place from the hoop 13 over the blocking balls 41 and the rotary bolt 39 to the lock cylinder 27 and to the key 55 inserted therein. Since the housing parts 21, 23 are also made from an electrically insulating material, the hoop 13 and the lock cylinder 27 are completely electrically insulated from one another.

The locking balls 41 can be made of metal in this embodiment in order to ensure high security against breaking open of the lock without thereby impairing the electrical insulation properties.

Figure 3:
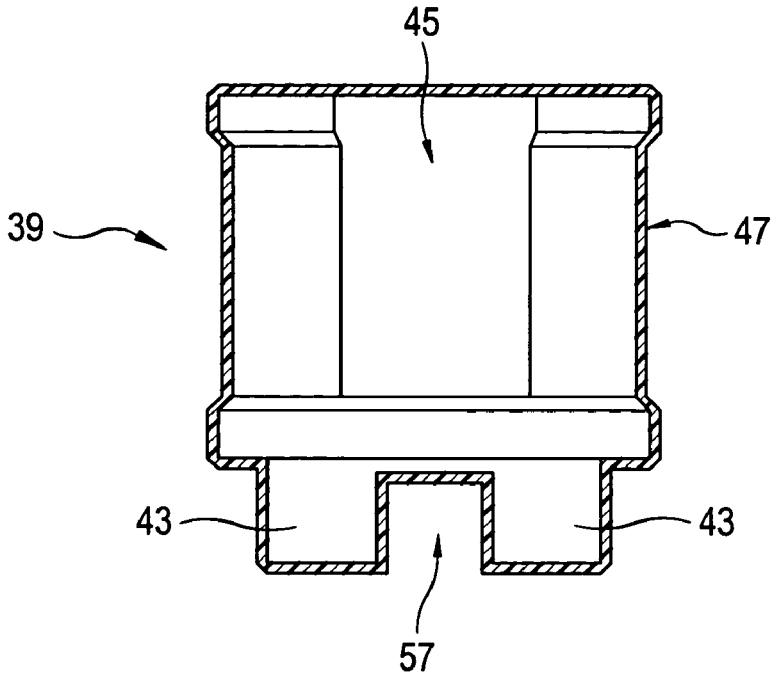
FIG. 3 shows a cross-sectional view of the rotary bolt of the embodiment in accordance with FIG. 2.

FIG. 3 shows a detailed view of the rotary bolt 39 in accordance with FIG. 2. A receiving recess 45 can be recognized arranged between two latching sections 47 in the upper region of the rotary bolt 39. An engagement recess 57 can be seen between two engagement necks 43 in the lower region.

Alternatively to the embodiment described, only the blocking balls 41 can also be made of an electrically insulating material, for example of ceramic material or of a hard plastic, in order to bring about the desired insulation between the hoop 13 and the lock cylinder 27. In this case, the hoop 13, the lock cylinder 27 and also the rotary bolt 39 can substantially be made of metal.

It must still be noted with respect to the embodiment in accordance with FIGS. 2 and 3 that blocking rollers, i.e. cylindrical blocking elements, can also be used instead of the blocking balls 41.

It must further be noted that the hoop 13—as shown in FIG. 2—can optionally be provided with an electrically insulating covering 59 at least along that section which projects out of the lock body 11 in the latched state. The insulating properties of the lock are thereby further improved.

Figure 4:
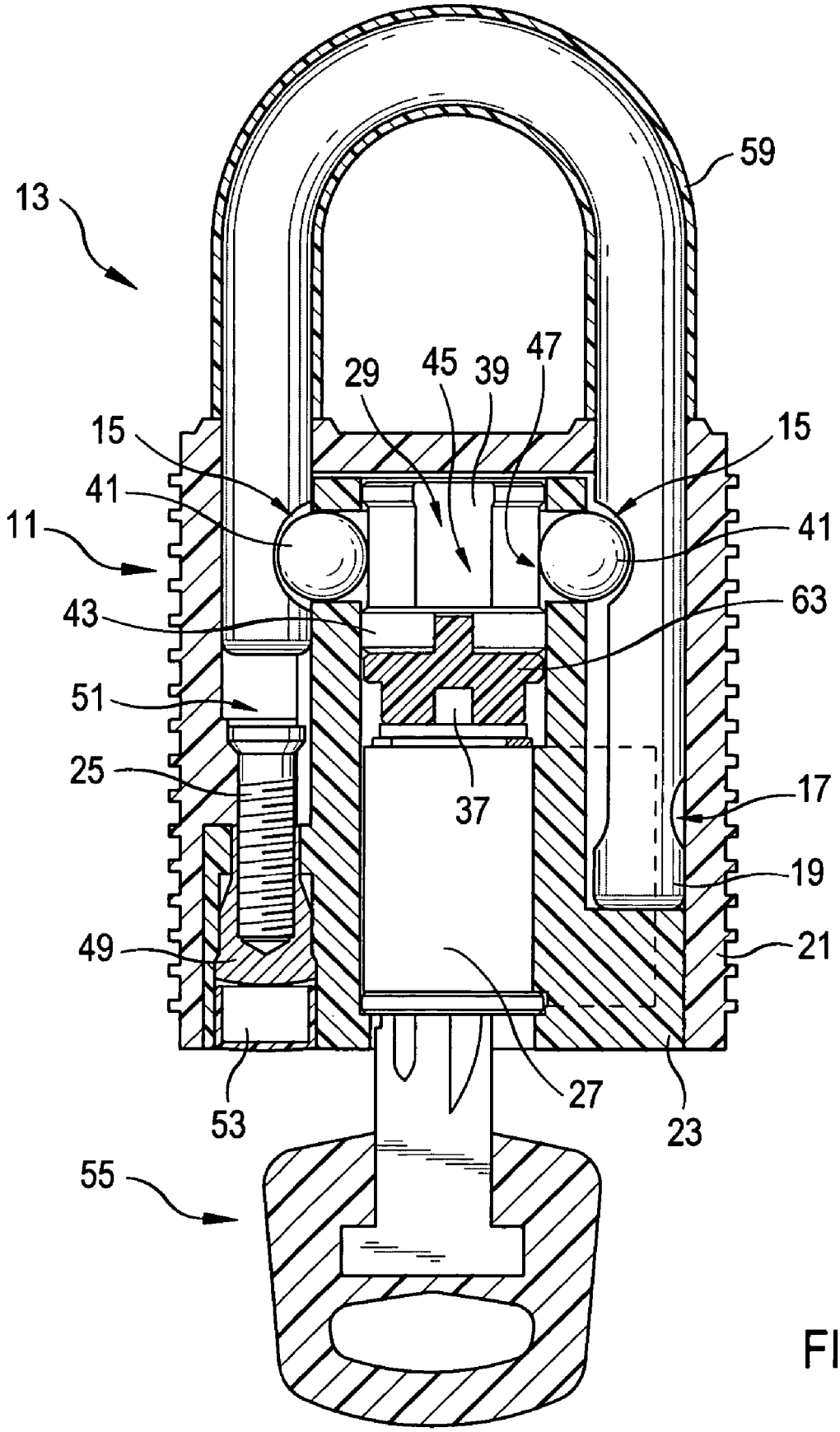
FIG. 4 shows a cross-sectional view of a further embodiment with a rotary bolt, two blocking balls and an additional adapter part.

FIG. 4 shows a further embodiment of a padlock in which the hoop 13 and the lock cylinder 27 are electrically insulated from one another. Unlike the embodiment in accordance with FIG. 2, the latching mechanism 29 has a rotary bolt 39, two blocking balls 41 cooperating with it and, in addition, an adapter part 61 arranged between the rotary bolt 39 and the lock cylinder 27. The rotary bolt 39 is rotationally fixedly coupled to the lock cylinder 27 via the adapter part 61. For this purpose, the adapter part 61 engages in shape-matched manner around the driver projection 37 of the lock cylinder 27 and the adapter part 61 is also connected to the rotary bolt 39by a shape-matched engagement.

In another respect, the function of the latching mechanism 29 in accordance with FIG. 4 corresponds to that of the embodiment in accordance with FIG. 2. In other words, the rotary bolt 39 in the blocking position shown in FIG. 4 brings the blocking balls 41 into blocking engagement with the hoop 13, with the rotary bolt 39 being able to be brought into a release position by an opening actuation of the lock cylinder 27, in which release position the receiving recesses 45 release the blocking balls 41 from the blocking engagement with the hoop 13.

In the embodiment in accordance with FIG. 4, the adapter part 61 consists of an electrically insulating material, for example of vinyl, while the rotary bolt 39 and the blocking balls 41 are made of metal. A high mechanical stability of the latching mechanism 29 is hereby ensured without having to dispense with the desired electrical insulation. If an attempt is made to pull the hoop 13 out of the lock body 11 by force, lateral forces are exerted via the latching recesses 15 of the hoop 13, namely onto the blocking balls 41 and thus onto the rotary bolt 39, and the parts 39, 41 can particularly easily withstand these lateral forces due to being made of metal. The adapter part 61, in contrast, only serves for electrical insulation and for the transfer of a rotary actuation of the lock cylinder 27 onto the rotary bolt 39, with, however, only comparatively low torsional forces occurring.

Figure 5:
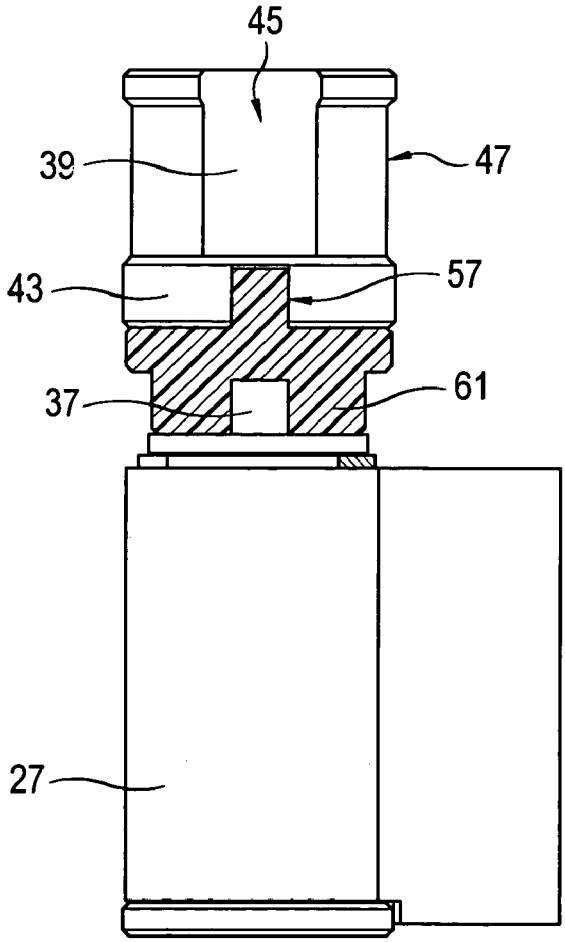
FIG. 5 shows the rotary bolt, the adapter part and the lock cylinder of the embodiment in accordance with FIG. 4.

FIG. 5 shows the linear arrangement of the lock cylinder 27, adapter part 61 and rotary bolt 39 in a detailed view.

It must still be noted with respect to the embodiment in accordance with FIG. 4 that blocking rollers can, for example, also be provided here instead of blocking balls 41.

Figure 6:
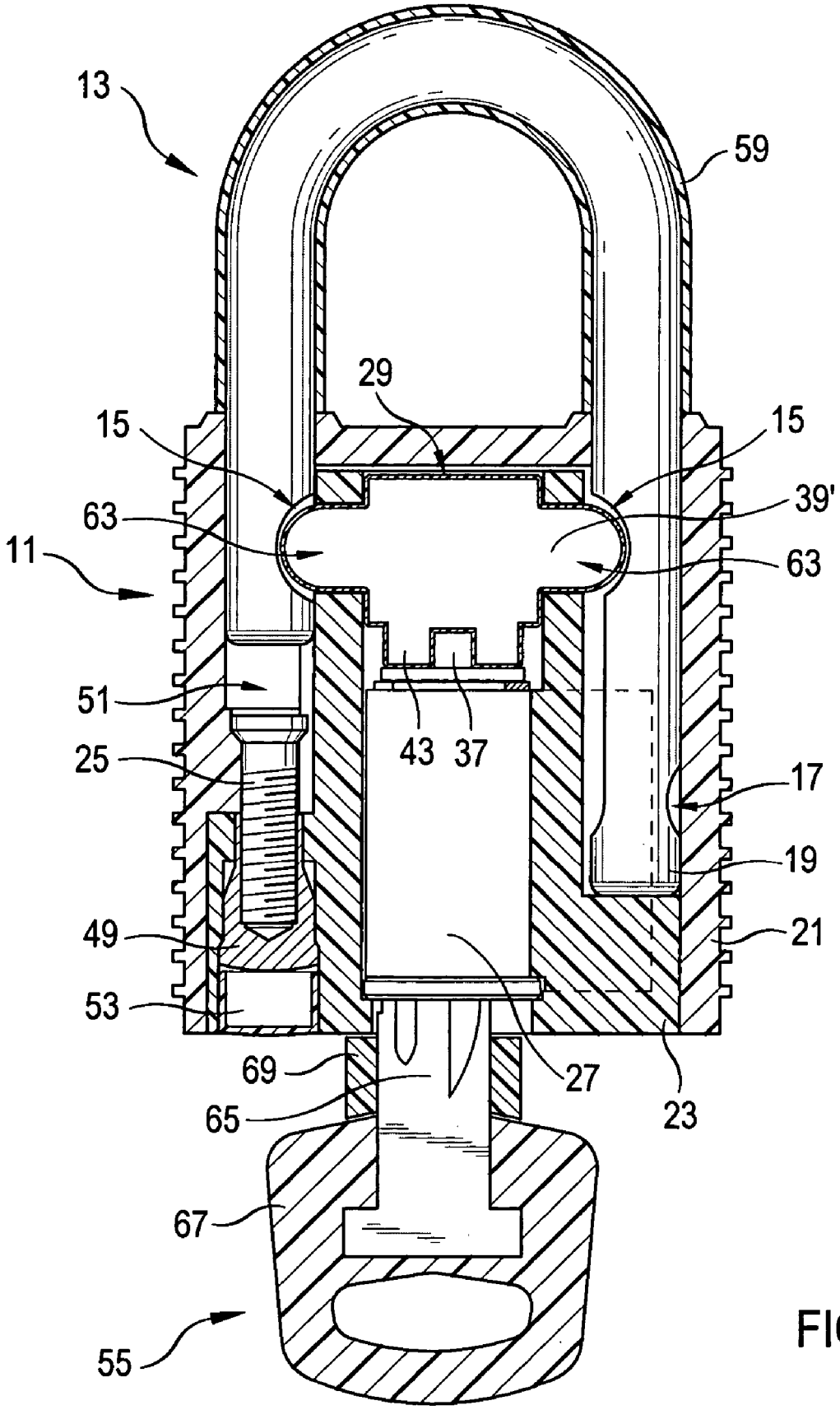
FIG. 6 shows a cross-sectional view of a further embodiment with a one-part rotary bolt.

FIG. 6 shows a further embodiment of a latching lock in which the hoop 13 and the lock cylinder 27 are electrically insulated from one another. Unlike the embodiment in accordance with FIG. 2, the latching mechanism 29 here has a one-part bolt element 39' which is coupled to the lock cylinder 27. The bolt element 39' is rotatably supported in the inner housing part 23 and it has eccentrically protruding engagement projections 63 along its periphery. They can optionally be brought into blocking engagement with the hoop 13 by a rotary actuation of the lock cylinder 27 and by a corresponding rotation of the bolt element 39' in order to latch the hoop to the lock body 11.

The bolt element 39' consists of an electrically insulating material, in particular of plastic (such as vinyl) or ceramic material. There is thus no electrically conductive connection between the hoop 13 and the lock cylinder 27.

FIG. 6 furthermore shows an optional further development which is possible in all of the explained embodiments. In accordance with this further development, the key 55 associated with the lock cylinder 27 has a neck 65 of metal and a key head 67 of an electrically insulating material such as plastic. The key neck 65 is provided with an insulating sleeve 69 of an electrically insulating material along a region which adjoins the key head 67 and projects from the lock cylinder 27 when the key 55—as shown in FIG. 6 —is inserted into the lock cylinder 27. This insulating sleeve 69 can also consist of plastic, for example, and it can be made in one piece with the key head 67 or the corresponding plastic covering. The insulating sleeve 69 has the effect that no metal part projects out of the lock cylinder 27 or out of the lower side of the lock body 11 in the position of use of the key 55.

Figure 7:
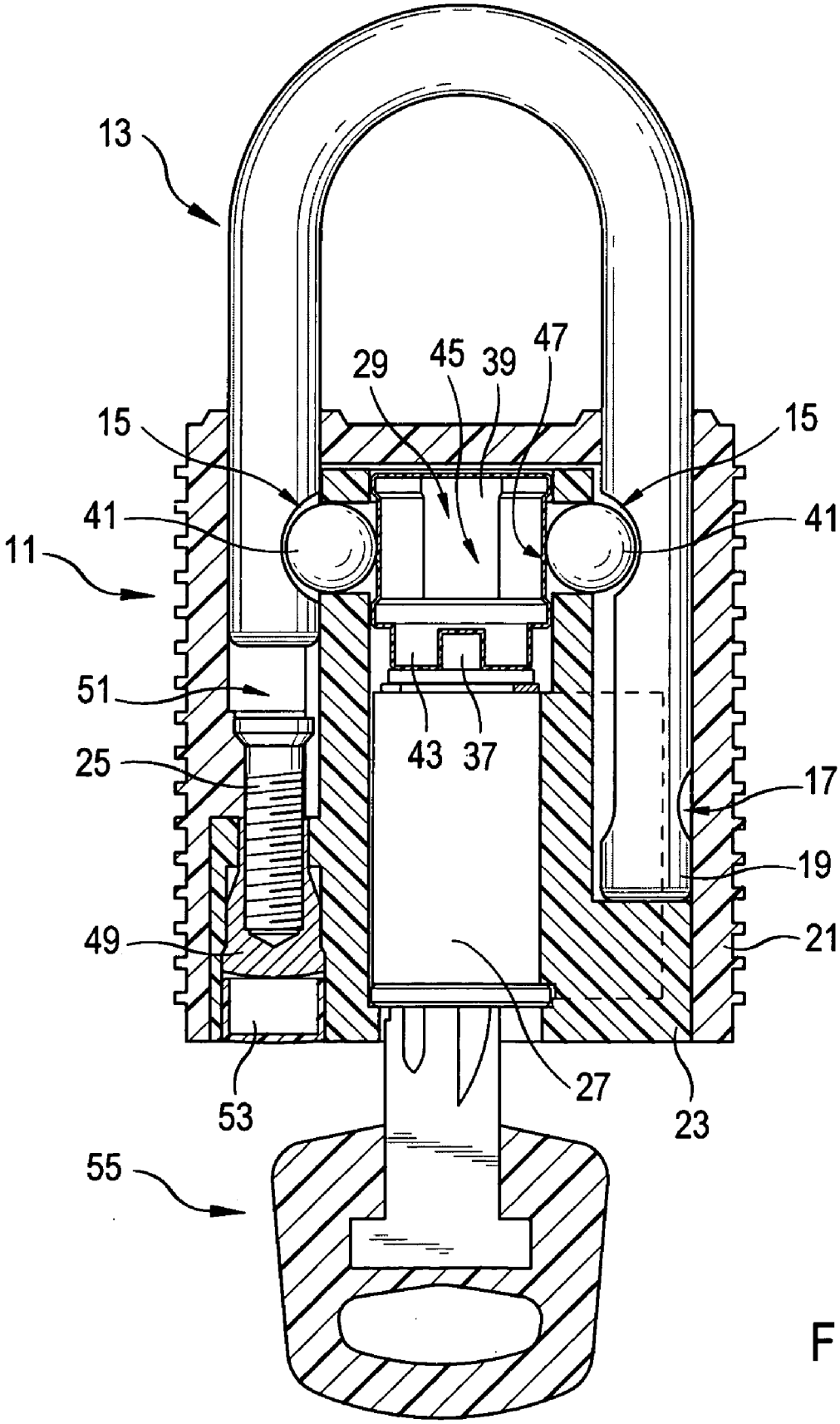
FIG. 7 shows a further embodiment with a hoop produced from an insulating material.

FIG. 7 shows an embodiment of a padlock in which—alternatively or additionally to the aforesaid embodiments—the hoop 13 consists completely of an electrically insulating material, for example of plastic or ceramic material. An electrical insulation of the lock cylinder 27 from the hoop 13 is thereby likewise ensured.

It must still be noted with respect to the explained embodiments that the respective hoop 13 and the lock cylinder 27 are electrically insulated from one another irrespective of whether the hoop 13—as shown in FIGS. 2, 4, 6 and 7—is latched to the lock body 11 or whether the hoop 13 is located in a release position in which the shorter limb projects from the lock body 11.

The electrical insulation of the hoop 13 and the lock cylinder 27 in accordance with the invention can furthermore be realized independently of whether the rotary bolt 39 or 39' is rotationally fixedly coupled to the lock cylinder 27 or whether a snap latch is provided by which the hoop 13 introduced into the lock body 11 is automatically latched, even if the key 55 is not inserted into the lock cylinder 27.

Figure 8:
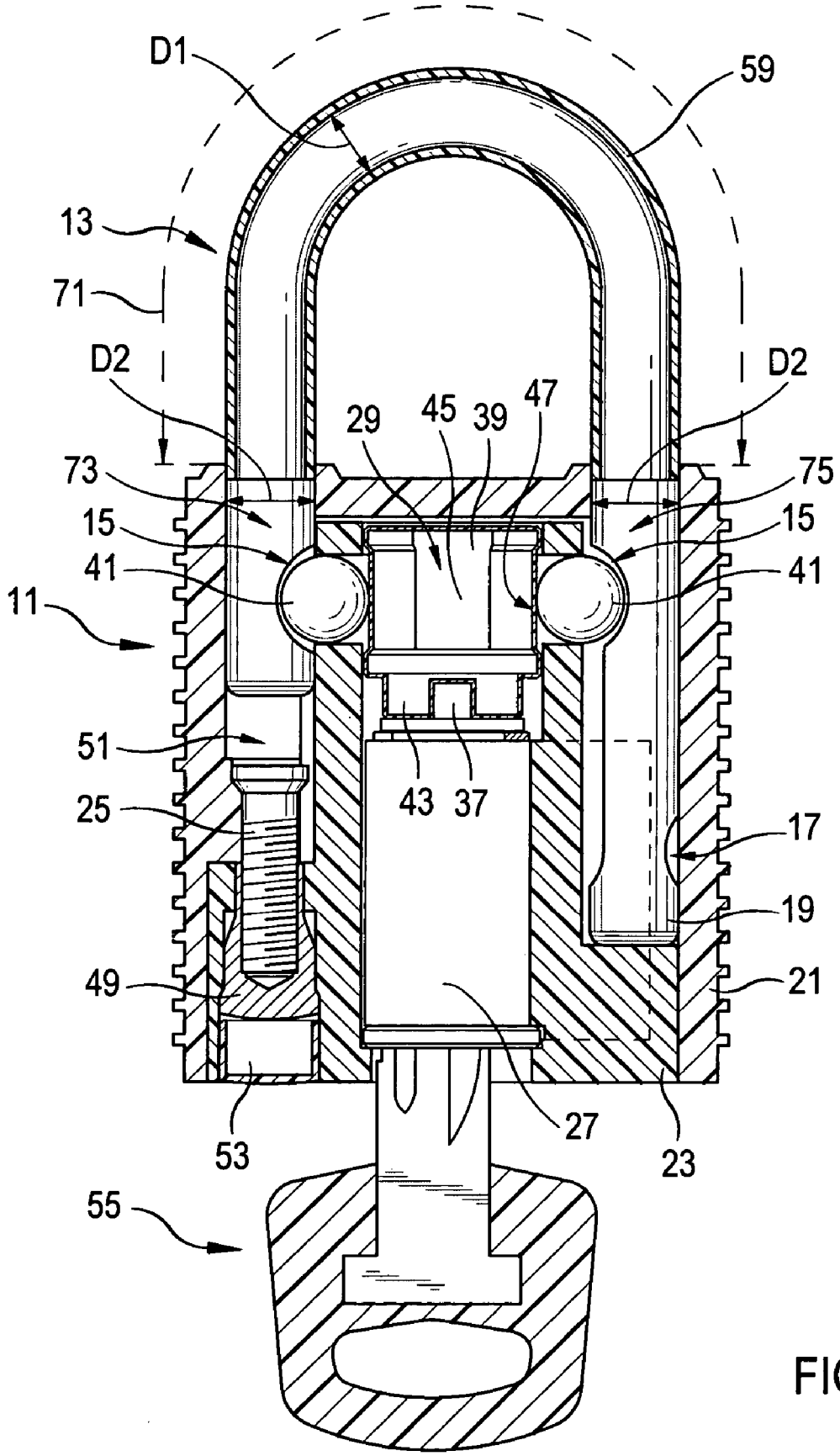
FIG. 8 shows a further embodiment with a hoop which has a covering of an insulating material along a section with a reduced diameter.

FIG. 8 shows a padlock in which the desired electrical insulation is realized solely by a covering 59 of the hoop 13 and by the housing. The hoop 13 consists of metal. The hoop 13 is turned to a reduced diameter D1 along a section 71 which projects out of the lock body 11 and slightly beyond it when the hoop 13 is latched. The hoop 13 is provided with a covering 59 of an electrically insulating plastic along this section 71. At least the outer housing part 21 likewise consists of an electrically insulating plastic.

Since a throughgoing electrical insulation is thus provided along the outer surface of the hoop section 71 and along the outer housing part 21 and since even a slight overlap of the electrical insulation is realized at the transition, no electrical voltage is transmitted to the lock cylinder 27 or to a key 55 inserted therein, even if the hoop section 71 or the outer housing part 21 contacts a live part. The padlock is thus particularly well suited as a "lock-out" lock.

A guide section 73 of the shorter limb and a guide section 75 of the longer limb of the hoop 13, which project into the lock body 11, have a diameter D2 which is larger than the diameter D1 of the hoop section 71 and which approximately corresponds to the outer diameter of the covering 59. The total diameter of the hoop 13 (including the covering 59 at the section 17) is thus approximately constant, apart from the latching recesses 15 and the ring groove 17. The total diameter has a normal dimension along the section 71 so that the hoop 13 can be led through an eyelet of an electrical master switch without problem. A good mechanical stability and guidance of the hoop 13 inside the lock body 11 is ensured by the comparatively large diameter D2 of the guide sections 73, 75, although the outer housing part 21 and preferably also the inner housing part 23 consist of plastic.

It must still be noted with respect to the padlock in accordance with FIG. 8 that the latching mechanism 29 can additionally be made electrically insulating, as explained in connection with FIGS. 2 to 6; however, this is not absolutely necessary.

It must furthermore be noted that the covering 59 shown in FIGS. 2, 4 and 6 can also be provided at a hoop section 71 with reduced diameter D1, as explained in connection with FIG. 8 above.

The invention claimed is:

1. A padlock comprising a lock body having a housing;

a lock hoop displaceably secured to the lock body;

a lock cylinder accommodated in the housing; and a latching mechanism accommodated in the housing enabling a latching of the hoop to the lock body, the latching mechanism having an electrically insulating bolt and at least one blocking element, the bolt being coupled to the lock cylinder, and, in a blocking position, bringing the at least one blocking element into blocking engagement with the hoop in order to latch the hoop to the lock body, wherein the bolt can be brought by an opening actuation of the lock cylinder into a release position in which the bolt releases the at least one blocking element from the blocking engagement, and wherein the bolt is made at least partly of an electrically insulating material;

wherein the latching mechanism releases at least one end of the hoop on an opening actuation of the lock cylinder such that this hoop end can be removed from the lock body;

wherein the housing comprises an electrically insulating material at least at its outer side; and wherein the hoop and the lock cylinder are electrically insulated from one another by intervening placement of the electrically insulating bolt within the chain of mechanically cooperating metal components of the padlock comprising the hoop, the lock cylinder and the latching mechanism, and wherein the electrically insulating bolt is the only component within the chain that includes electrically insulating material.

2. A padlock in accordance with claim 1, wherein the the bolt is made at least partly of plastic or of ceramic material.

3. A padlock in accordance with claim 1, wherein the at least one blocking element is formed by a blocking ball or by a blocking roller.

4. A padlock in accordance with claim 1, wherein two blocking elements are provided which are arranged opposite one another with respect to the bolt and which can be brought into blocking engagement with a respective end of the hoop.

5. A padlock in accordance with claim 1, wherein the housing has an inner housing part and an outer housing part;

wherein, in the assembled state of the housing, the inner housing part is inserted into the outer housing part and is secured to the outer housing part by means of a securing screw;

wherein the securing screw is inserted into a receiving passage of the outer housing part; and wherein the receiving passage is closed by the hoop when the hoop is latched to the lock body.

6. A padlock in accordance with claim 1, wherein a key for an opening actuation of the lock cylinder is associated with the lock cylinder;

wherein the key has a neck of metal and a key head of an electrically insulating material; and wherein the key neck is provided with an insulating sleeve of an electrically insulating material along a region which adjoins the key head and projects from the lock cylinder when the key is inserted into the lock cylinder.

* * * * *